US010431901B2

(12) United States Patent
Black et al.

(10) Patent No.: US 10,431,901 B2
(45) Date of Patent: Oct. 1, 2019

(54) BROADBAND SURFACE SCATTERING ANTENNAS

(71) Applicant: Searete LLC, Bellevue, WA (US)

(72) Inventors: Eric J. Black, Bothell, WA (US); Brian Mark Deutsch, Snoqualmie, WA (US); Alexander Remley Katko, Seattle, WA (US); Melroy Machado, Seattle, WA (US); Jay Howard McCandless, Alpine, CA (US); Yaroslav A. Urzhumov, Bellevue, WA (US)

(73) Assignee: The Invention Science Fund, LLC, Bellevue, WA (US)

( * ) Notice: Subject to any disclaimer, the term of this patent is extended or adjusted under 35 U.S.C. 154(b) by 162 days.

(21) Appl. No.: 15/387,987

(22) Filed: Dec. 22, 2016

(65) Prior Publication Data

US 2017/0187123 A1 Jun. 29, 2017

Related U.S. Application Data

(60) Provisional application No. 62/271,524, filed on Dec. 28, 2015.

(51) Int. Cl.

| | |
|---|---|
| ***H01Q 21/00*** | (2006.01) |
| ***H01Q 21/06*** | (2006.01) |
| ***H01Q 23/00*** | (2006.01) |
| ***H01Q 13/26*** | (2006.01) |
| *H01Q 9/04* | (2006.01) |

(52) U.S. Cl.

CPC ..... *H01Q 21/06* (2013.01); *H01Q 13/26* (2013.01); *H01Q 21/0075* (2013.01); *H01Q 23/00* (2013.01); *H01Q 9/0407* (2013.01)

(58) Field of Classification Search

CPC .... H01Q 21/06; H01Q 13/16; H01Q 21/0075; H01Q 23/00

USPC ..... 343/844

See application file for complete search history.

(56) References Cited

U.S. PATENT DOCUMENTS

| | | | | |
|---|---|---|---|---|
| 4,914,446 | A * | 4/1990 | Lindenmeier | H01Q 1/1278 343/704 |
| 5,281,974 | A * | 1/1994 | Kuramoto | H01Q 21/22 333/161 |
| 6,094,166 | A * | 7/2000 | Martek | H01Q 1/246 342/372 |
| 6,642,908 | B2 * | 11/2003 | Pleva | B60K 31/0008 343/700 MS |
| 6,667,714 | B1 * | 12/2003 | Solondz | H01Q 1/246 342/368 |
| 7,365,695 | B2 * | 4/2008 | Thomas | H01P 1/184 342/373 |
| 8,102,330 | B1 * | 1/2012 | Albers | H01Q 5/40 333/117 |
| 9,252,485 | B2 * | 2/2016 | Haskell | H01Q 3/2694 |
| 9,515,380 | B2 * | 12/2016 | Iso | H01Q 3/32 |

(Continued)

OTHER PUBLICATIONS

PCT International Search Report; International App. No. PCT/US2016/068341; dated Apr. 14, 2017; pp. 1-5.

(Continued)

*Primary Examiner* — Huedung X Mancuso

(57) ABSTRACT

A surface scattering antenna with a tightly-coupled or tightly-connected array of radiators provides an adjustable antenna with broadband instantaneous bandwidth.

24 Claims, 4 Drawing Sheets

(56) References Cited

U.S. PATENT DOCUMENTS

| | | | |
|---|---|---|---|
| 2004/0209572 | A1 | 10/2004 | Thomas |
| 2009/0153432 | A1 | 6/2009 | Manasson et al. |
| 2015/0318618 | A1 | 11/2015 | Chen et al. |

OTHER PUBLICATIONS

European Patent Office, Extended European Search Report, Pursuant to Rule 62 EPC; App. No. Ep 16882434.0; Jul. 22, 2019 (received by our; Agent on Jul. 17, 2019); pp. 1-13.

* cited by examiner

BROADBAND SURFACE SCATTERING ANTENNAS

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)).

PRIORITY APPLICATIONS

The present application claims benefit of priority of U.S. Provisional Patent Application No. 62/271,524, entitled BROADBAND SURFACE SCATTERING ANTENNAS, naming ERIC J. BLACK ET AL. as inventors, filed Dec. 28, 2015, which was filed within the twelve months preceding the filing date of the present application or is an application of which a currently co-pending priority application is entitled to the benefit of the filing date.

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

BACKGROUND

The principal function of any antenna is to couple an electromagnetic wave guided within the antenna structure to an electromagnetic wave propagating in free space. Many approaches exist to implement this coupling and have been intensely studied due to the vast practical applications of antennas. See, e.g., Constantine A. Balanis, *Antenna Theory,* 3d Ed., Wiley 2005.

In antennas based on surface scattering antennas, coupling between the guided wave and propagating wave is achieved by modulating the electromagnetic properties of a surface in electromagnetic contact with the guided wave. This controlled surface modulation may be referred to as a "modulation pattern." The guided wave in the antenna may be referred to as a "reference wave" or "reference mode" and the desired free space propagating wave pattern may be referred to as the "radiative wave" or "radiative mode."

Surface scattering antennas are described, for example, in U.S. Patent Application Publication No. 2012/0194399 (hereinafter "Bily I"), with improved surface scattering antennas being further described in U.S. Patent Application Publication No. 2014/0266946 (hereinafter "Bily II"). Surface scattering antennas that include a waveguide coupled to adjustable scattering elements loaded with lumped devices are described in U.S. application Ser. No. 14/506,432 (hereinafter "Chen I"), while various holographic modulation pattern approaches are described in U.S. patent application Ser. No. 14/549,928 ("hereinafter Chen II"). All of these patent applications are herein incorporated by reference in their entirety, which shall be collectively referred to hereinafter as the "MSAT applications."

Surface scattering antennas comprise arrays of discrete radiating elements with the element spacing being typically less than about a quarter wavelength at the antenna operating frequency. Radiation from each element can be discretely modulated such that their collective effect approximates a desired modulation pattern.

Modulation has typically been accomplished in surface scattering antennas by tuning the resonant frequency of the individual radiating elements, which increases or decreases the energy coupled from the reference wave into the radiative wave. This approach typically yields a narrowband antenna, as the deeply subwavelength radiating elements are typically high-Q radiators that radiate efficiently by virtue of their bandwidth constraint.

Increased bandwidth may be desirable in applications such as broadband communications. Therefore, techniques to increase the bandwidth of a surface scattering antenna are of practical interest.

SUMMARY

Embodiments include antennas, methods, and systems that provide a surface scattering antenna with broadband instantaneous bandwidth.

Surface scattering antennas typically include high-Q radiating elements, where the sizes of the individual antenna element unit-cells are deeply subwavelength. The ability of a surface scattering antenna to shape the radiated pattern typically improves as the unit-cell size is reduced, because the additional elements provide additional phase-sampling points in the otherwise (largely) amplitude-controlled adaptive array.

In approaches where the antenna elements are regarded as isolated individual antennas in an array, it may be preferable to have the Q of each element scale inversely with antenna size. In other approaches, according to embodiments of the present invention, the antenna elements are not regarded as isolated individual antennas but as elements in a mutually-coupled system of radiators. Mutual coupling is a phenomenon that occurs when two nearby radiating elements each perturb the other's behavior away from what one would expect from a simple superposition of the two antenna responses. This behavior is usually viewed negatively in the case of phased array antennas, where array design and operation depends on the feasibility of superimposing the pattern of an isolated element with that of a pre-calculated antenna "array factor."

In a highly coupled array, the individual unit cells are not antennas on their own at all. Instead, they are part of a much larger antenna where the Chu limit of relevance is that of the entire antenna surface (and not the individual radiators). This immediately relieves the constraints on bandwidth and efficiency due to the electrically small individual elements.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
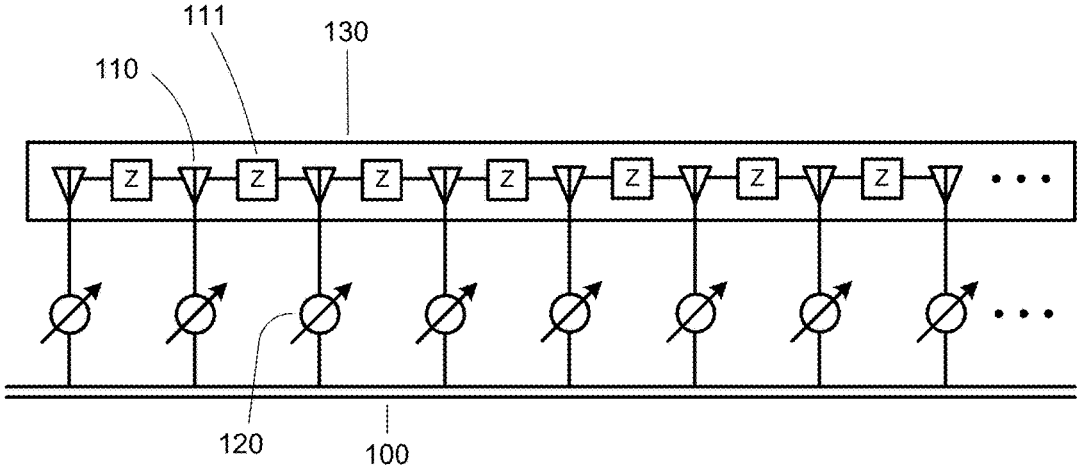
FIG. 1 depicts a schematic embodiment of a broadband surface scattering antenna.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

An illustrative embodiment of a broadband surface scattering antenna is schematically depicted in FIG. 1. The antenna includes a transmission line 100 that is coupled to a plurality of radiators 110 by a respective plurality of adjustable feed structures 120. The radiators 110 are mutually coupled so that they may be regarded as components of a collective radiating structure 130 that spans the extent of the plurality of radiators. The mutual coupling between adjacent radiators is schematically represented by the symbols 111 which can represent capacitive couplings between the radiators (as with a so-called "tightly-coupled array") or inductive couplings between the radiators (as with a so-called "connected array") or both.

While the transmission line 100 is shown as a one-dimensional line, this is a symbolic depiction that is not intended to be limiting. In some approaches, the transmission line is a one-dimensional transmission line such as a waveguide, microstrip, stripline, or coaxial cable. In other approaches, the transmission line is a two-dimensional transmission line such as a parallel plate waveguide or dielectric slab waveguide. In yet other approaches, the transmission line is a quasi-two-dimensional transmission line in the sense that it is composed of a set of parallel one-dimensional transmission lines that fill a two-dimensional area. In these quasi-two-dimensional approaches, the transmission line may include a corporate feed network that delivers energy from a single input port to the set of parallel one-dimensional transmissions lines (e.g. with a binary tree corporate feed structure).

Figure 2:
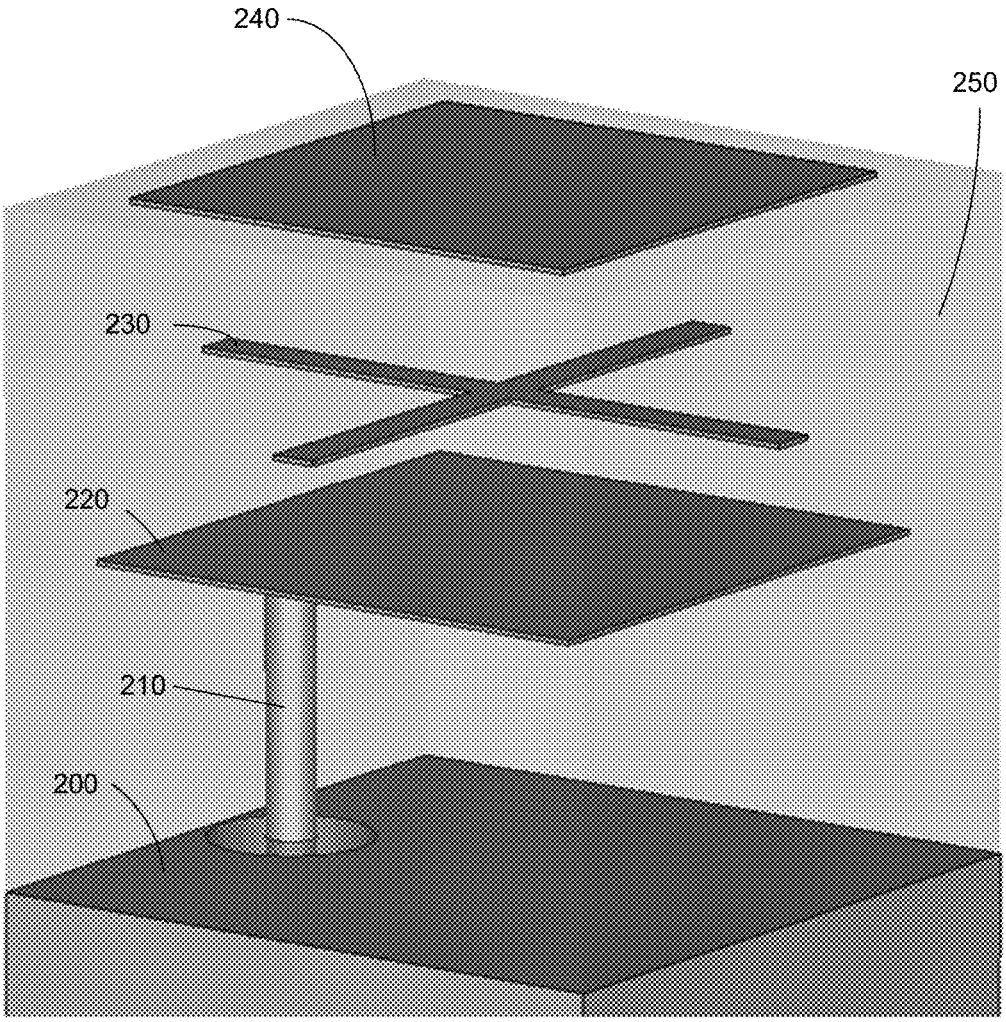
FIG. 2 depicts an example of a radiator for an exemplary unit cell.

The radiators 110 are subwavelength radiators with strong mutual coupling 111 between adjacent radiators. "Subwavelength" might mean, for example, that the spacing between adjacent elements is less than or equal to about one-half, one-third, one-fourth, or one-fifth of a free-space wavelength corresponding to an operating frequency of the antenna. Various subwavelength radiator structures are described in the MSAT applications previously cited. The strong mutual coupling between adjacent radiators can be achieved by virtue of proximity between adjacent radiators and/or by adding further structures that enhance the mutual coupling between adjacent radiators. An example is depicted in FIG. 2 which shows a radiator unit cell with additional inductive and capacitive coupling structures. In the cell, a lower ground plane 200 with a coaxial input 210 feeds a patch antenna 220 (a configuration sometimes referred to as a PIFA). The patch by itself is capacitively coupled to other patches in adjacent unit cells and they collectively form a capacitive plane. An inductive plane is placed above the patch. In the figure, the inductive plane is a metallic grid but since the figure only shows a single unit cell, it appears as a floating cross shape 230. It is important to understand that this cross shape is connected to crosses in the adjacent unit cells. Above the inductive plane, a capacitive plane made of isolated square metal patches 240 is placed. The metallic structures are supported by a dielectric substrate (transparent shaded volume 250). In one illustrative example, the geometry of the inductive and capacitive planes can be tuned to enhance the inter-element mutual coupling such that the collective behavior shows a band-pass characteristic with pass-bandwidth of 37%. This is a substantial improvement over the isolated PIFA which shows only 3-5% bandwidth.

Figure 3:
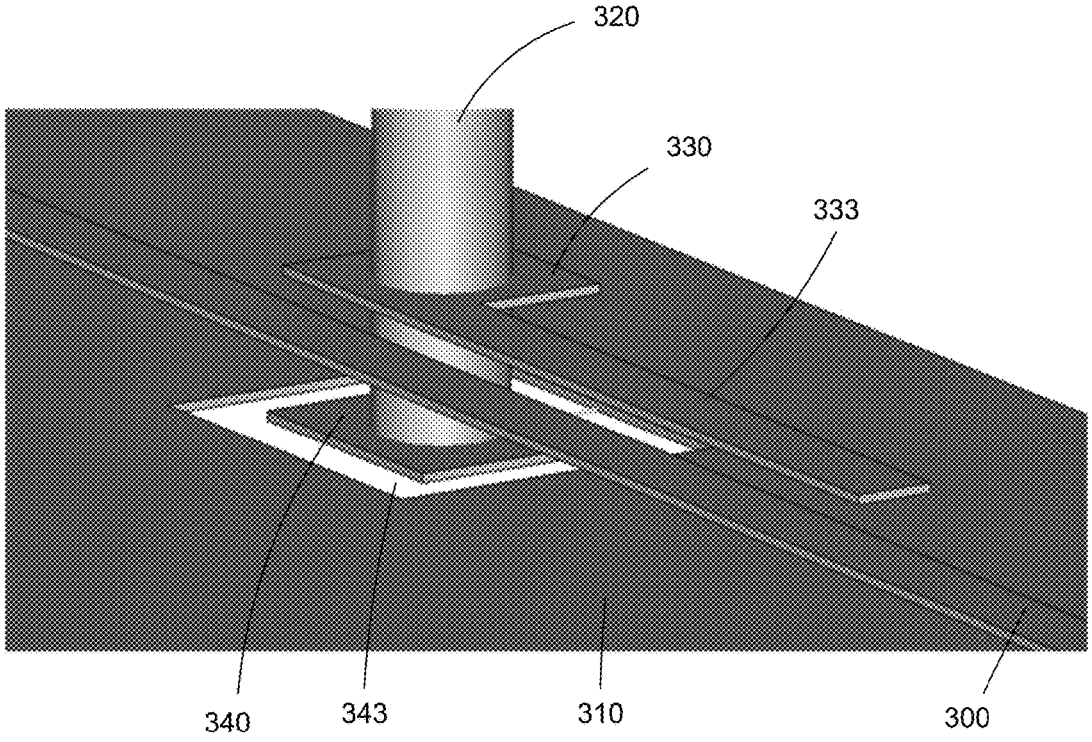
FIG. 3 depicts an example of a feed structure for an exemplary unit cell.

Because the radiators are rendered broadband by their strong mutual coupling, some embodiments modulate the antenna pattern not by adjusting the resonance frequencies of the radiators but instead by adjusting the individual feed structures 120 of the radiators. Since the adjustable feed structures 120 are not bound by the Chu limit, it is possible to use low-Q (wideband) resonance shifts to modulate the power delivered to the individual antenna elements. An example of an adjustable feed structure for a unit cell is depicted in FIG. 3. In the figure, a microstrip waveguide line 300 is shown passing over a ground plane 310. A cylindrical via 320 is located near the microstrip and connected to a square pad 330 with microstrip stub 333. The via is also connected to a square pad 340 with a square cutout 343 in the ground plane 310. These structures are supported by a dielectric medium (not shown). The bottom via-connected pad 340 and the ground plane 310 are connected by a variable component (not shown) such as a varactor, MEMS, field effect transistor (FET) or other variable impedance device. Suitable variable impedance devices are discloses in the MSAT applications, cited above, and include lumped elements whose impedances may be adjusted by adjusting bias voltages of the lumped elements. The geometric dimensions of the stub, stripline, pads and via are tuned such that the energy flowing along the stripline is coupled into the via. The via is connected to the antenna element (such as shown in FIG. 2) by a coaxial structure (e.g. by extending the via 320 to provide the coaxial line 210 that feeds the patch antenna 220). The coupling strength between the via path and the microstrip path is modulated by adjusting the impedance of the variable component. This non-contact method of coupling energy between transmission paths is sometimes referred to as "evanescent coupling."

Figure 4:
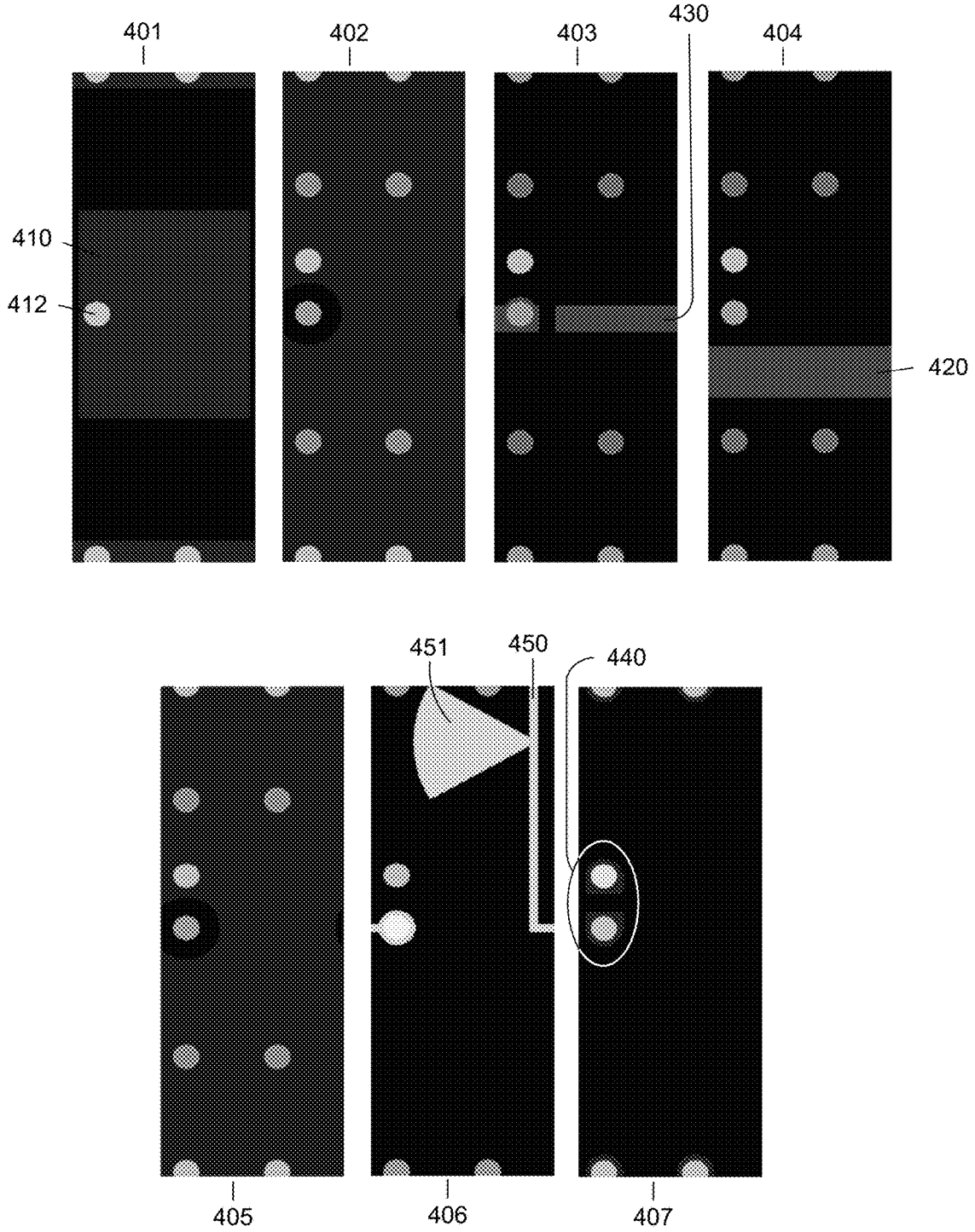
FIG. 4 shows a layer-by-layer depiction of an exemplary unit cell.

With reference now to FIG. 4, an illustrative embodiment of a unit cell is depicted as a layout of successive metal layers (401 (top) to 407 (bottom)) in a multilayer PCB process. The unit cell includes as radiator a patch 410 (in red) above the upper ground plane 402 (in blue), fed by a via 412 (in green) that extends all the way to the bottom layer 407. The transmission line is implemented as a stripline 420 (in green) sandwiched between the upper and lower ground planes 402 and 405 (in blue). To provide the adjustable feed structure, the via 412 is connected to a stub 430 (green) that is evanescently coupled to the stripline 420 (in the example, the stripline 420 and stub 430 are on different layers for convenience of PCB lamination, but the structures can reside on the same layer). The pads 440 (in red) allow for placement of a variable impedance device (not shown) on the bottom layer 407 connected between the via 412 and the ground planes 402, 405. Finally, layer 406 supports a bias voltage line 450; the adjustable feed structure is then adjusted by varying the voltage on this bias voltage line and thus adjusting the voltage across the variable impedance device. The unit cell optionally includes a stub reflector flag 451 to provide RF isolation between the bias voltage line 450 and the patch 410.

One embodiment provides a method of radiating with a desired antenna pattern, such as an antenna pattern having a main beam that is pointed in a desired direction (other types of desired antenna patterns are discussed in the MSAT applications, cited above). The method includes the step of propagating a confined electromagnetic wave along a transmission line. For example, an electromagnetic wave may be propagated along the transmission line 100 of FIG. 1. The method further includes the step of, during the propagating, selectively feeding the confined electromagnetic wave to a tightly-coupled or connected array of radiators that collectively radiate to provide a free-space electromagnetic wave with the desired antenna pattern. For example, with reference to FIG. 1, the adjustable feed structures 120 can be adjusted to selectively feed the wave that is propagating along the transmission line 100 to the array of radiators 110. The adjustments of the individual feed structures can be discrete adjustments (e.g. binary or grayscale) or continuous adjustments. For example, in embodiments where the adjustable feed structures are adjustable by virtue of having variable impedance devices such as variable impedance lumped elements, the feed structures can be adjusted by discretely or continuously adjusting bias voltages for the variable impedance devices. Numerous variable impedance devices that are discretely or continuously adjustable by adjusting bias voltages are described herein and further described in the MSAT applications, cited previously.

Another embodiment provides a method of receiving with a desired antenna pattern. The method includes the step of receiving a free-space electromagnetic wave with a tightly-coupled or connected array of radiators, thereby collectively exciting the array of radiators. For example, with reference to the antenna of FIG. 1, the antenna can receive a free-space electromagnetic wave that excites each of the radiators 110. The method further includes the step of generating a confined electromagnetic wave in a transmission line by selectively feeding the transmission line with energy from the collectively excited array of radiators. For example, again with reference to FIG. 1, the excited radiators deliver energy to the transmission line 100 by way of the adjustable feed structures 120; by adjusting each of the individual feed structures, the amount of energy delivered by each excited radiator to the transmission line 100 can be adjusted. Again, the adjustments of the individual feed structures can be discrete adjustments (e.g. binary or grayscale) or continuous adjustments. For example, in embodiments where the adjustable feed structures are adjustable by virtue of having variable impedance devices such as variable impedance lumped elements, the feed structures can be adjusted by discretely or continuously adjusting bias voltages for the variable impedance devices. Numerous variable impedance devices that are discretely or continuously adjustable by adjusting bias voltages are described herein and further described in the MSAT applications, cited previously.

Another embodiment provides a system for controlling a broadband surface scattering antenna. For example, with reference to the antenna of FIG. 1, the system can include control circuitry that is operable to adjust each of the individually adjustable feed structures 120 of the antenna. For example, if each of the adjustable feed structures is adjustable by varying a bias control voltage, the control circuitry can include a plurality of bias voltage controllers corresponding to the plurality of adjustable feed structures. In some approaches, the adjustable feed structures may be organized in rows and columns, and the control circuitry is correspondingly arranged to address each row and each column. Optionally, the system can also include the antenna itself. Optionally, the system can also include a storage medium on which is written a set of antenna configurations and circuitry for reading a selected antenna configuration from the storage medium so that the individually adjustable feed structures 120 can then be adjusted according to the selected antenna configuration.

Another embodiment provides a method of operating a broadband surface scattering antenna. For example, the control circuitry of the above system can be operated to adjust the antenna by adjusting each of the adjustable feed structures of the antenna. The method of operating can also include operating the antenna to transmit and/or to receive electromagnetic waves.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

In a general sense, those skilled in the art will recognize that the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). Those having skill in the art will recognize that the subject matter described herein may be implemented in an analog or digital fashion or some combination thereof.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

One skilled in the art will recognize that the herein described components (e.g., steps), devices, and objects and the discussion accompanying them are used as examples for the sake of conceptual clarity and that various configuration modifications are within the skill of those in the art. Consequently, as used herein, the specific exemplars set forth and the accompanying discussion are intended to be representative of their more general classes. In general, use of any specific exemplar herein is also intended to be representative of its class, and the non-inclusion of such specific components (e.g., steps), devices, and objects herein should not be taken as indicating that limitation is desired.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

With respect to the appended claims, those skilled in the art will appreciate that recited operations therein may generally be performed in any order. Examples of such alternate orderings may include overlapping, interleaved, interrupted, reordered, incremental, preparatory, supplemental, simultaneous, reverse, or other variant orderings, unless context dictates otherwise. With respect to context, even terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An antenna, comprising:

a transmission line;

a tightly-coupled or connected array of radiators; and a respective array of adjustable feed structures joining the transmission line to the radiators;

wherein each of the adjustable feed structures includes:

a feed line having an input port with an evanescent coupling to the transmission line and an output port that is coupled to the respective radiator; and a variable impedance component connected to the feed line and adjustable to vary the evanescent coupling.

2. The antenna of claim 1, where the tightly-coupled or connected array of radiators is a tightly coupled array of radiators that are capacitively coupled.

3. The antenna of claim 1, where the tightly-coupled or connected array of radiators is a connected array of radiators that are inductively coupled.

4. The antenna of claim 1, wherein the transmission line is a one-dimensional transmission line providing a one-dimensional aperture for the antenna.

5. The antenna of claim 4, wherein the one-dimensional transmission line is a microstrip line.

6. The antenna of claim 1, wherein the transmission line is a two-dimensional transmission line providing a two-dimensional aperture for the antenna.

7. The antenna of claim 6, wherein the two-dimensional transmission line includes a set of parallel one-dimensional transmission lines.

8. The antenna of claim 7, wherein the two-dimensional transmission line further includes a corporate feed network for the set of parallel one-dimensional transmission lines.

9. The antenna of claim 7, wherein the set of parallel one-dimensional transmission lines is a set of parallel microstrip lines.

10. The antenna of claim 1, wherein the tightly-coupled or connected array of radiators is an array of subwavelength elements having an inter-element mutual coupling that provides an antenna bandwidth substantially greater than an isolated individual bandwidth of any of the radiators in the tightly-coupled or connected array of radiators.

11. The antenna of claim 10, wherein the array of subwavelength elements is an array of subwavelength patch elements.

12. The antenna of claim 10, wherein the tightly-coupled or connected array of broadband radiators includes one or more reactive structures extending across and coupled to the array of subwavelength elements to enhance the inter-element mutual coupling.

13. The antenna of claim 1, wherein:

the feed line includes a stub positioned adjacent to the transmission line to provide the evanescent coupling.

14. The antenna of claim 1, wherein the variable impedance component is a lumped element having a first terminal connected to the feed line and a second terminal connected to a ground plane.

15. The antenna of claim 14, wherein the lumped element is a varactor.

16. The antenna of claim 14, wherein the lumped element is a MEMS device.

17. The antenna of claim 14, wherein the lumped element is a transistor.

18. The antenna of claim 14, wherein each of the adjustable feed structures includes a bias voltage line connected to the feed line.

19. The antenna of claim 14, wherein each of the adjustable feed structures includes a bias voltage line connected to a third terminal of the lumped element.

20. An antenna, comprising:

a transmission line;

a tightly-coupled or connected array of radiators; and a respective array of adjustable feed structures joining the transmission line to the radiators;

wherein the tightly-coupled or connected array of radiators is an array of subwavelength elements having an inter-element mutual coupling that provides an antenna bandwidth substantially greater than an isolated individual bandwidth of any of the radiators in the tightly-coupled or connected array of radiators;

wherein the array of subwavelength elements is an array of subwavelength patch elements; and wherein the array of subwavelength patch elements is an array of coplanar patches having small gaps between neighboring patches, the small gaps providing the inter-element mutual coupling as a coplanar capacitance between neighboring patches.

21. An antenna, comprising:

a transmission line;

a tightly-coupled or connected array of radiators; and a respective array of adjustable feed structures joining the transmission line to the radiators;

wherein the tightly-coupled or connected array of radiators is an array of subwavelength elements having an inter-element mutual coupling that provides an antenna bandwidth substantially greater than an isolated individual bandwidth of any of the radiators in the tightly-coupled or connected array of radiators;

wherein the tightly-coupled or connected array of broadband radiators includes one or more reactive structures extending across and coupled to the array of subwavelength elements to enhance the inter-element mutual coupling; and wherein the one or more reactive structures include an inductive surface.

22. The antenna of claim 21, wherein:

the array of subwavelength elements is an array of subwavelength patch elements; and the inductive surface is a respective array of interconnected crosses forming a conductive grid positioned above and parallel to the subwavelength patch elements.

23. An antenna, comprising:

a transmission line;

a tightly-coupled or connected array of radiators; and a respective array of adjustable feed structures joining the transmission line to the radiators;

wherein the tightly-coupled or connected array of radiators is an array of subwavelength elements having an inter-element mutual coupling that provides an antenna bandwidth substantially greater than an isolated individual bandwidth of any of the radiators in the tightly-coupled or connected array of radiators;

wherein the tightly-coupled or connected array of broadband radiators includes one or more reactive structures extending across and coupled to the array of subwavelength elements to enhance the inter-element mutual coupling; and wherein the one or more reactive structures include a capacitive surface.

24. The antenna of claim 23, wherein:

the array of subwavelength elements is an array of subwavelength patch elements; and the capacitive surface is a respective array of patches positioned above and parallel to the subwavelength patch elements.

* * * * *